US010758052B1

(12) United States Patent
Lai et al.

(10) Patent No.: US 10,758,052 B1
(45) Date of Patent: Sep. 1, 2020

(54) HEIGHT ADJUSTMENT STRUCTURE OF ARMREST

(71) Applicants: Yu-Shan Lai, Taibao (TW); Yen-Chi Lai, Chiayi (TW)

(72) Inventors: Yu-Shan Lai, Taibao (TW); Yen-Chi Lai, Chiayi (TW)

( * ) Notice: Subject to any disclaimer, the term of this patent is extended or adjusted under 35 U.S.C. 154(b) by 0 days.

(21) Appl. No.: 16/369,367

(22) Filed: Mar. 29, 2019

(51) Int. Cl.
*A47C 7/54* (2006.01)

(52) U.S. Cl.
CPC ..... *A47C 7/541* (2018.08)

(58) Field of Classification Search
CPC ..... A47C 7/541; A47C 1/0305; A47C 1/0303; A47C 1/03
USPC ..... 297/411.36
See application file for complete search history.

(56) References Cited

U.S. PATENT DOCUMENTS 5,265,938 A * 11/1993 Melhuish ..... A47C 1/03 297/411.36
6,209,840 B1 * 4/2001 Chen ..... A47C 1/03 248/118
8,128,172 B2 * 3/2012 Tsai ..... A47C 1/03 297/411.36
9,173,498 B2 * 11/2015 Colasanti ..... A47C 7/54

* cited by examiner

*Primary Examiner* — Milton Nelson, Jr.
(74) *Attorney, Agent, or Firm* — Alan D. Kamrath; Karin L. Williams; Mayer & Williams PC

(57) ABSTRACT

A height adjustment structure for an armrest contains: an accommodation sleeve for accommodating a fixer and a slider, a cap connected with a support arm, a pedestal, and a pull member. The pull member includes an extension extending out of a first window of the accommodation sleeve so as to pull an engagement protrusion to horizontally remove from or engage into one of multiple recesses of the fixer. The fixer includes a groove and two closed slots. The slider includes an extending lid, a second window, two tabs, a cutout, an elongated orifice, and an abutting protrusion. The pull member includes a receiving orifice, a spring, and a tilted orifice. The engagement protrusion abuts against the cutout and inserts into the one recess, and the engagement protrusion includes a column extending from a side thereof and inserted into the elongated orifice via the tilted orifice.

2 Claims, 5 Drawing Sheets

HEIGHT ADJUSTMENT STRUCTURE OF ARMREST

BACKGROUND OF THE INVENTION

Field of the Invention

The present invention relates to a height adjustment structure of an armrest which contains an extension configured to drive the engagement protrusion to move inward and outward so that the engagement protrusion is removed from or is engaged into one of multiple recesses, thus adjusting the height of the armrest.

Description of the Prior Art

A conventional height adjustment structure of an armrest is applicable for various chairs so as to adjust a height of the armrest according to using requirements.

The conventional height adjustment structure contains an engagement protrusion mating with a spring so as to be lifted or descended, but a support arm is lifted to a maximum height gradually when adjusting its height and the support arm is pressed to a minimum height (when the engagement protrusion is located on the maximum height of the support arm, it moves into a dead point, and the engagement protrusion is removed when the support arm is pressed to the minimum height, so the support arm is lifted and is descended limitedly), thereafter the support arm is lifted again, thus causing inconvenient adjustment.

Furthermore, a drive button exposes outside the armrest so that when a user moves the drive button upward, an engagement structure is removed from one of multiple recesses so as to change a height of the armrest. After releasing the drive button, the engagement structure is engaged into another recess adjacent to the one recess, thus adjusting the height of the armrest quickly.

However, the drive button and the engagement structure are driven in a swinging manner (For example, the drive button swings to drive the engagement structure to swing. Alternatively, the engagement structure is swung to engage in the one recess or another recess, thus the engagement structure is not adjustable freely because of its limited swing angle), thus adjusting the height of the armrest unstably.

The present invention has arisen to mitigate and/or obviate the afore-described disadvantages.

SUMMARY OF THE INVENTION

The primary objective of the present invention is to provide a height adjustment structure of an armrest which contains an accommodation sleeve configured to accommodate a fixer and a slider, a cap covered on tops of the slider and the accommodation sleeve and connected with a support arm, a bottom of the fixer being coupled with a pedestal, and a pull member being received in the slider, wherein the pull member includes an extension extending out of a first window of the accommodation sleeve from a top of the pull member so as to pull an engagement protrusion to horizontally remove from or engage into one of multiple recesses of the fixer, thus adjusting a height of the armrest.

The pull member is slid in the slider upward and downward to drive the engagement protrusion to horizontally move inward and outward, such that the engagement protrusion is horizontally removed from or is engaged into the one recess of the fixer, and a height of the support arm is adjustable relative to the fixer (the pedestal). Thereby, the user freely adjusts the height of the support arm based on usage requirements.

The engagement protrusion is horizontally removed from or is engaged into the one recess of the fixer stably (the engagement protrusion moves into the one recess after extending out of the slider), thus adjusting a height of the armrest smoothly.

DETAILED DESCRIPTION OF THE PREFERRED EMBODIMENTS

The present invention will be clearer from the following description when viewed together with the accompanying drawings, which show, for purpose of illustrations only, a preferred embodiment in accordance with the present invention.

Figure 1:
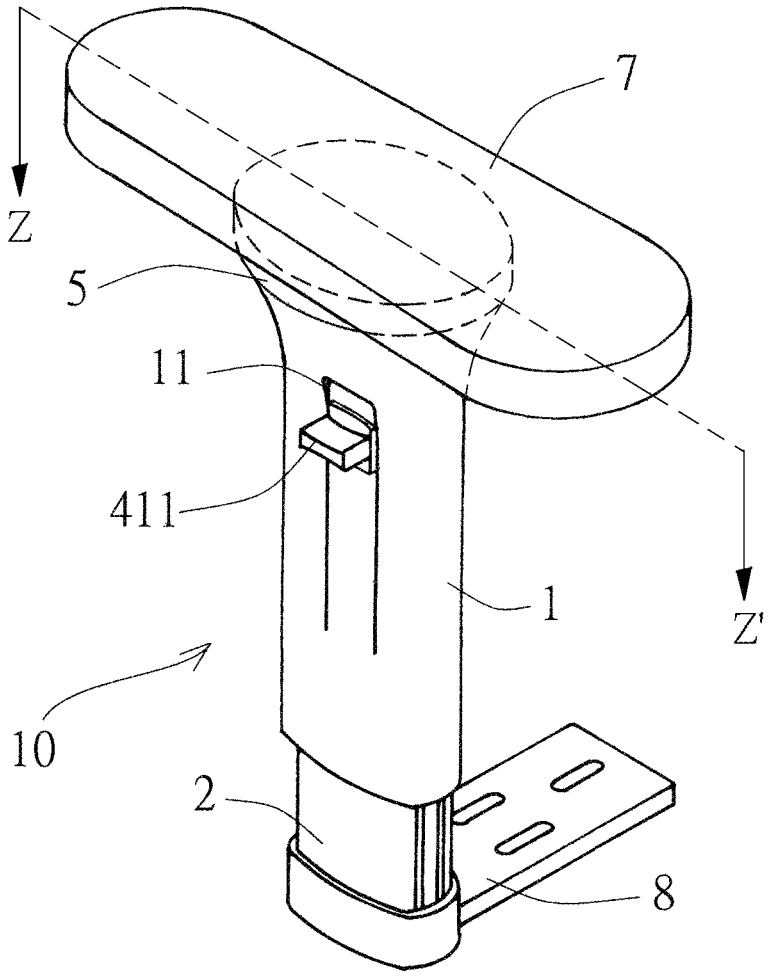
FIG. 1 is a perspective view showing the assembly of a height adjustment structure of an armrest according to a preferred embodiment of the present invention.

With reference to FIG. 1, a height adjustment structure of an armrest according to a preferred embodiment of the present invention includes an accommodation sleeve 1 configured to accommodate a fixer 2 and a slider 3. A cap 5 is covered on tops of the slider 3 and the accommodation sleeve 1 and is connected with a support arm 7, a bottom of the fixer 2 is coupled with a pedestal 8, and a pull member 4 is received in the slider 3, wherein the pull member 4 includes an extension 41 extending out of a first window 11 of the accommodation sleeve 1 from a top of the pull member 4 so as to pull an engagement protrusion 6 to horizontally remove from or engage into one of multiple recesses 23 of the fixer 2, thus adjusting a height of the armrest.

Figure 2:
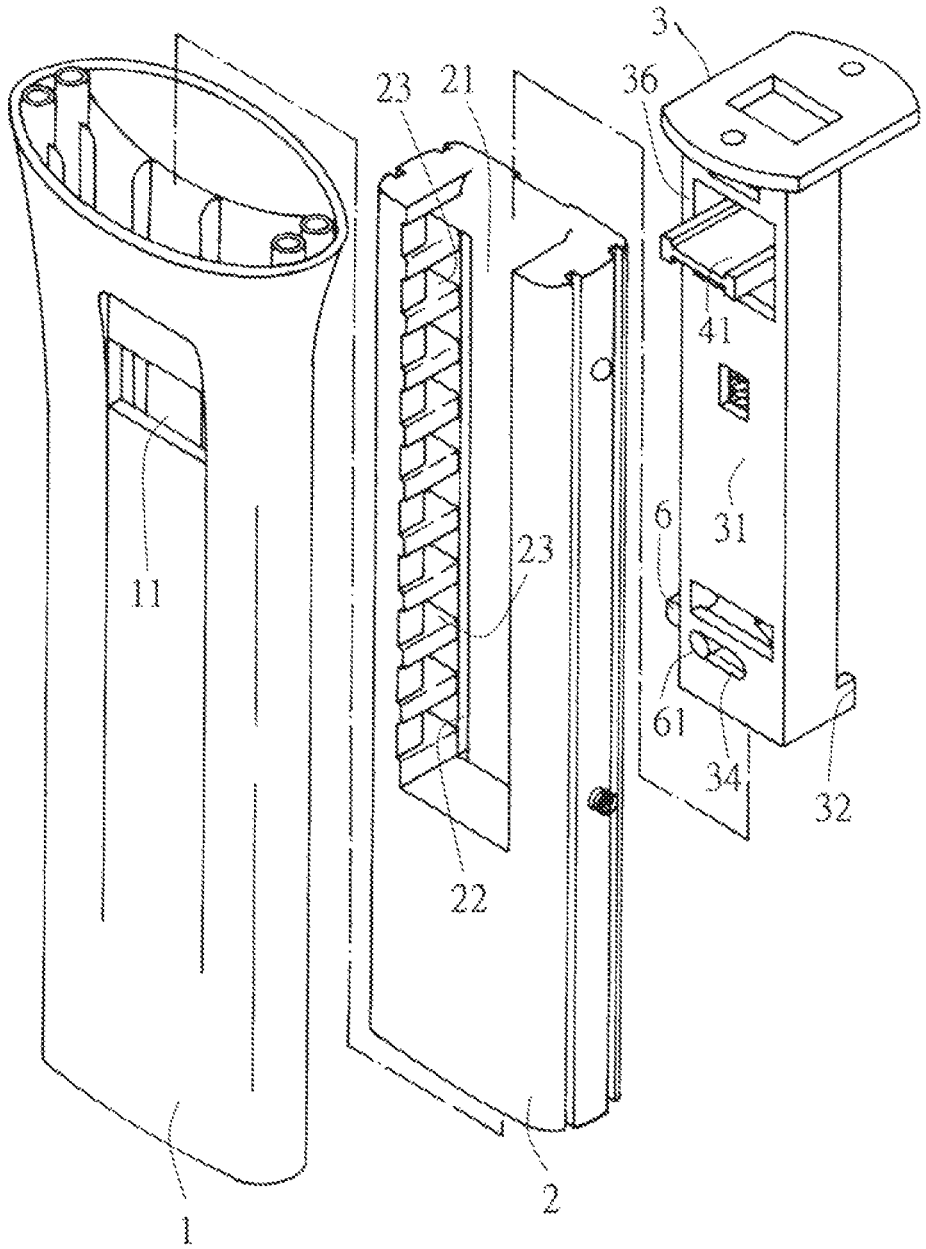
FIG. 2 is a perspective view showing the exploded components of the height adjustment structure of the armrest according to the preferred embodiment of the present invention.

The fixer 2 includes a groove 21 defined therein, two closed slots 22 formed on two sides of the groove 21 respectively, and the multiple recesses 23 arranged on one of the two sides of the groove 21 (as shown in FIG. 2).

Figure 3:
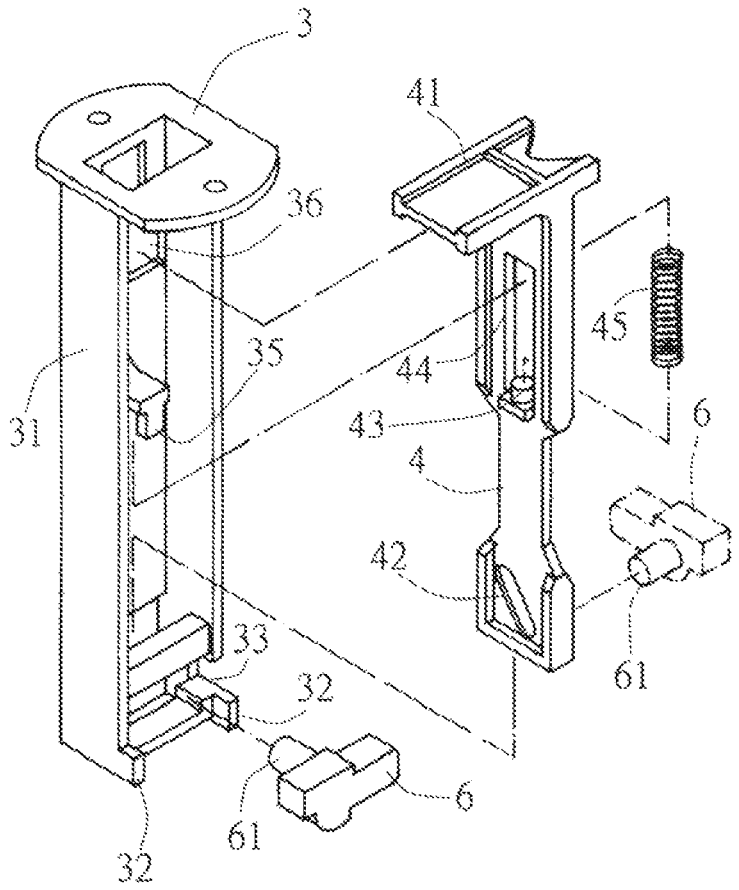
FIG. 3 is a perspective view showing the exploded components of a part of the height adjustment structure of the armrest according to the preferred embodiment of the present invention.

The slider 3 includes an extending lid 31 (as illustrated in FIG. 3) slidably engaged with the groove 21, a second window 36 formed on the extending lid 31 and corresponding to the first window 11, two tabs 32 respectively extending from two sides of a lower end of the extending lid 31 and corresponding to the two closed slots 22 (the two closed slots 22 do not extend over the groove 21), such that when the slider 3 slides in the groove 21, the slider 3 does not slide out of the fixer 2 by using the two tabs 32. The slider 3 further includes a cutout 33 defined on one of the two sides of the extending lid 31 and corresponding to the one recess 23, an elongated orifice 34 formed along a height of the cutout 33 on the extending lid 31, and an abutting protrusion 35 extending from an inner wall of the extending lid 31.

The pull member 4 is slidably accommodated in the slider 3 upward and downward, and the pull member 4 includes the extension 41 extending out of the first window 11 of the accommodation sleeve 1 from the top of the pull member 4 via the second window 36, a receiving orifice 44 defined on a middle section of the pull member 4 so as to accommodate a holder 43, and a tilted orifice 42 formed on a lower end of the pull member 4, wherein a top and a bottom of the tilted orifice 42 correspond to and overlap with a left side and a right side of the elongated orifice 34 individually, when the pull member 4 slides upward and downward.

The engagement protrusion 6 abuts against the cutout 33 and inserts into the one recess 23, and the engagement protrusion 6 includes a column 61 extending from a side thereof and inserted into the elongated orifice 34 via the tilted orifice 42.

The pull member 4 is accommodated in the slider 3, the abutting protrusion 35 extends out of the receiving orifice 44 of the pull member 4 so that a spring 45 of the pull member 4 is fitted into the abutting protrusion 35 and the holder 43, and the pull member 4 slides normally, hence the column 61 of the engagement protrusion 6 is limited by the tilted orifice 42 and the elongated orifice 34, extends out of the cutout 33, and is engaged into the one recess 23. When the engagement protrusion 6 is pushed inward, the slider 3 is accommodated into the groove 21 of the fixer 2. After the cap 5 is connected on the top of the slider 3 (the cap 5 is in various shapes and is configured to connect the slider 3 with the accommodation sleeve 1, then the cap 5 is coupled with the support arm 7), the fixer 2 is fitted into the accommodation sleeve 1 (In the meantime, the extension 41 extends out of the second window 36, thus it is pushed into the accommodation sleeve 1 and extends out of the first window 11 so as to fit with a drive button 411 configured to be manually operated by a user), the cap 5 is covered on the top of the accommodation sleeve 1 and is coupled with the support arm 7, such that the bottom of the fixer 2 is coupled with the pedestal 8 so as to form the armrest 10.

Figure 4:
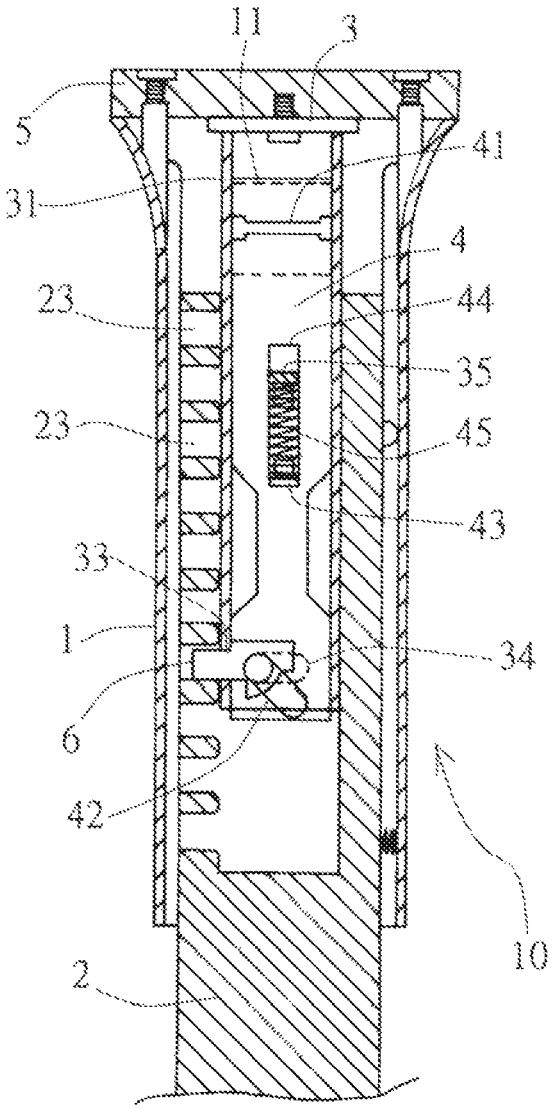
FIG. 4 is a cross sectional view along Z-Z' showing the operation of the height adjustment structure of the armrest according to the preferred embodiment of the present invention.
Figure 5:
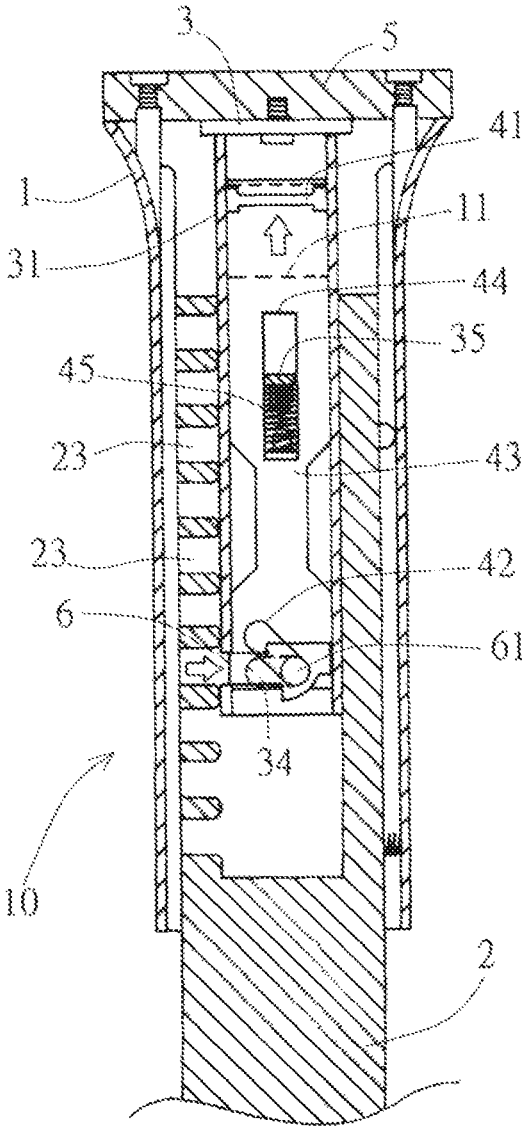
FIG. 5 is another cross sectional view Z-Z' showing the operation of the height adjustment structure of the armrest according to the preferred embodiment of the present invention.

In operation, the extension 41 is moved upward so as to drive the pull member 4 to slide in the slider 3 upward (as shown in FIG. 4, the holder 43 is slid toward the abutting protrusion 35 to press the spring 45), and the pull member 4 actuates the column 61 to move inward along the elongated orifice 34 by way of the tilted orifice 42, such that the engagement protrusion 6 moves inward to remove from the one recess 23, and a height of the support arm 7 is adjustable relative to the fixer 2 (i.e., the support arm 7, the cap 5, the accommodation sleeve 1, the pull member 4, and the slider 3 are lifted and descended relative to the fixer 2). When the extension 41 is released so that the spring 45 pushes the pull member 4 downward, the pull member 4 actuates the column 61 to move outward along the elongated orifice 34 by way of the tilted orifice 42 (as illustrated in FIG. 5), and the engagement protrusion 6 is engaged into the one recess 23 via the cutout 33 based on an adjusting direction of the support arm 7, thus fixing the armrest 10.

The column 61 of the engagement protrusion 6 is actuated by the tilted orifice 42 of the pull member 4 to move leftward and rightward in the elongated orifice 34 of the slider 3 so that the engagement protrusion 6 is engaged into or is removed from the one recess 23 stably and smoothly, thus supporting the armrest 10 sufficiently.

While various embodiments in accordance with the present invention have been shown and described, it is clear to those skilled in the art that further embodiments may be made without departing from the scope of the present invention.

What is claimed is:

1. A height adjustment structure for an armrest comprising:

an accommodation sleeve, a fixer and a slider, a cap covered on tops of the slider and the accommodation sleeve and connected with a support arm, a bottom of the fixer being coupled with a pedestal, and a pull member received in the slider, the pull member including an extension extending out of a first window of the accommodation sleeve from a top of the pull member so as to pull an engagement protrusion to horizontally remove from or engage into one of multiple recesses of the fixer; wherein the fixer includes a groove defined therein, two closed slots formed on two sides of the groove respectively, and the multiple recesses arranged on one of the two sides of the groove;

the slider includes an extending lid slidably engaged with the groove, a second window formed on the extending lid and corresponding to the first window, two tabs respectively extending from two sides of a lower end of the extending lid and corresponding to the two closed slots, a cutout defined on one of the two sides of the extending lid and corresponding to the one recess, an elongated orifice formed along a height of the cutout on the extending lid, and an abutting protrusion extending from an inner wall of the extending lid;

the pull member is slidably accommodated in the slider upward and downward, and the pull member includes the extension extending out of the first window of the accommodation sleeve from the top of the pull member via the second window, a receiving orifice defined on a middle section of the pull member so as to accommodate a holder, a spring defined between the abutting protrusion and the holder, and a tilted orifice formed on a lower end of the pull member, wherein a top and a bottom of the tilted orifice correspond to and overlap with a left side and a right side of the elongated orifice individually, when the pull member slides upward and downward; and the engagement protrusion abuts against the cutout and inserts into the one recess, and the engagement protrusion includes a column extending from a side thereof and inserted into the elongated orifice via the tilted orifice;

wherein the pull member is accommodated in the slider, the column of the engagement protrusion is limited by the tilted orifice and the elongated orifice, extends out of the cutout, and is engaged into the one recess, wherein when the engagement protrusion is pushed inward, the slider is accommodated into the groove of the fixer, and after the cap is connected on the top of the slider, the fixer is fitted into the accommodation sleeve, the cap is covered on the top of the accommodation sleeve and is coupled with the support arm.

2. The height adjustment structure as claimed in claim 1, wherein a drive button extends out of the extension when fitted into the extension.

* * * * *